US008835730B2

(12) United States Patent
Bagale

(10) Patent No.: US 8,835,730 B2
(45) Date of Patent: Sep. 16, 2014

(54) LATCH FOR TRAVEL GUITAR WITH HINGED NECK

(71) Applicant: Adrian M. Bagale, Marshall, MI (US)

(72) Inventor: Adrian M. Bagale, Marshall, MI (US)

(73) Assignee: Voyage-Air Guitar Inc., Livermore, CA (US)

( * ) Notice: Subject to any disclaimer, the term of this patent is extended or adjusted under 35 U.S.C. 154(b) by 0 days.

(21) Appl. No.: 13/745,130

(22) Filed: Jan. 18, 2013

(65) Prior Publication Data

US 2014/0047968 A1 Feb. 20, 2014

Related U.S. Application Data

(60) Provisional application No. 61/588,116, filed on Jan. 18, 2012.

(51) Int. Cl.
*G10D 3/00* (2006.01)

(52) U.S. Cl.
USPC ..... 84/293

(58) Field of Classification Search
USPC ..... 84/267, 290, 291, 293
See application file for complete search history.

(56) References Cited

U.S. PATENT DOCUMENTS

| | | | | |
|---|---|---|---|---|
| 6,353,164 | B1 * | 3/2002 | Corsi | 84/293 |
| 8,273,974 | B1 * | 9/2012 | Gonzalez | 84/293 |
| 2013/0247742 | A1 * | 9/2013 | Tarohra | 84/298 |

* cited by examiner

*Primary Examiner* — Kimberly Lockett
(74) *Attorney, Agent, or Firm* — Handal & Morofsky LLC

(57) ABSTRACT

The inventive folding guitar comprises a guitar body and a guitar neck which includes a fretboard. A hinge connects the guitar neck to the guitar body. The hinge is configured to enable the guitar neck to pivot relative to the guitar body. A securing means for selectively securing the guitar neck to the guitar body that prevents the guitar neck from pivoting relative to the guitar body. A guitar neck angle adjusting means for adjusting an angle of the guitar neck relative to the guitar body is provided so that a height of a guitar string relative to the fretboard can be adjusted.

10 Claims, 11 Drawing Sheets

Figure 1
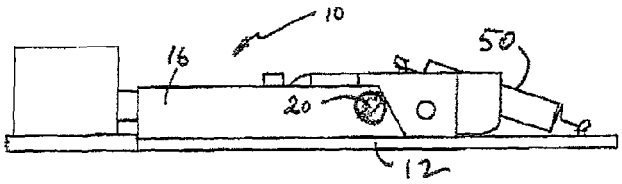
Figure 2
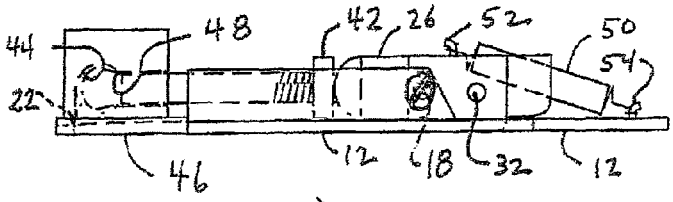
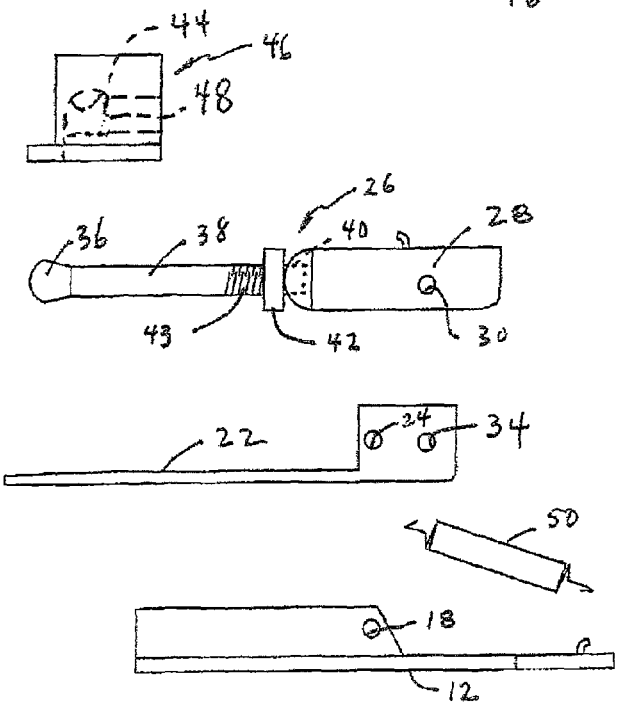
Figure 3
Figure 4
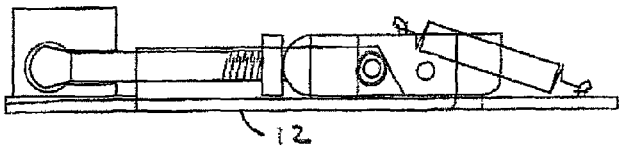

LATCH FOR TRAVEL GUITAR WITH HINGED NECK

CROSS REFERENCE TO RELATED APPLICATIONS

This application claims the priority of U.S. provisional patent application No. 61/588,116, filed Jan. 18, 2012 and U.S. application Ser. No. 12/817,882, filed Jun. 17, 2010 which has issued as U.S. Pat. No. 8,119,882.

TECHNICAL FIELD

The invention relates to a latch for locking the neck of a hinged neck traveling guitar in place.

STATEMENT REGARDING FEDERALLY SPONSORED RESEARCH OR DEVELOPMENT (Not applicable)

BACKGROUND OF THE INVENTION

The manufacture of note producing musical instruments began as a search for the mechanical equivalent of the human voice. This in fact remained the standard through the Middle Ages and into the Renaissance and the early modern period.

Stringed instruments have been known since ancient times. These included such instruments as the lute, a guitar-like instrument with a sound box and fingerboard. A New Kingdom (ancient Egypt, 1380 BC) bronze in the collection of the Metropolitan Museum of Art depicts a dancing Nubian raised on his toes with one knee cocked, left hand high working a fingerboard and right hand plucking the strings in a pose which might be illustrative of a modern rock musician.

But the lute has a much more ancient history, perhaps originating with West Semitic nomadic people who brought the instrument to Mesopotamia, where the archaeological record includes representations dating back to the Akkadian period (2350 to 2170 B.C.), being introduced to the Egyptians, perhaps at the end of the Middle Kingdom Hyksos dynasties (XV to XVII dynasty, 1730 to 1580 B.C.).

In more recent times, stringed lute-like musical instruments continue to be among the most popular instruments. Folk artists throughout the United States have used the guitar, sometimes one of the homemade varieties, in a wide range of musical genres including blues, bluegrass, and so forth.

In contrast to percussive instrumentation, the need for amplification of the relatively weak sounds of strings, reeds, and vibrating human lips presented challenges to early musical instrument manufacturers. These challenges were met primarily by resonant systems that mechanically concentrate, and output musical sound. There is a demanding standard in the stability of the instrument if high-quality sound is to be produced.

Moreover, over the years, artists playing acoustic stringed instruments have introduced a wide variety of playing techniques into the music surrounding these instruments. While, perhaps, the ancients only plucked the strings of the lute to achieve a musical tone which gradually decayed, later artists used the bow to produce notes of relatively constant and somewhat controllable amplitude. Modern artists employ a variety of techniques in their performances. Acoustic blues performers may rap their instruments with fingertips, palms or knuckles. Certain violin compositions, typically played by having a horsehair bundle slide across the strings, also call for the strings to be plucked. This results in yet greater demands being put on the mechanical stability of the instrument.

Given the popularity of stringed musical instruments, especially the guitar, people often take them along when traveling. However, they are bulky and poorly suited to convenient transport. They are unlikely to fit into airlines stowaway spaces or under airline seats. In response to this need, guitars with folding necks have been proposed. See for example my earlier U.S. Design Pat. No. 516,114, and my earlier pending U.S. patent application Ser. No. 11/640,095, filed Dec. 15, 2006. While this instrument is effective, it is difficult to make requiring significant handwork and fine tuning.

In order for a hinged neck traveling guitar to be used, one must employ a latch to hold the neck in the playing position after the neck has been moved from the travel or storage position to the playing position by rotation of the neck about the hinge. This latch should be easy to use and at the same time positively lock the neck in the proper position, or the acoustics of the guitar will be degraded.

SUMMARY OF THE INVENTION

In accordance with the invention, a latch is provided which is easy to use, requiring only that the user insert a ball-terminated arms in a catch and rotate a lever.

The inventive folding guitar comprises a guitar body and guitar neck. A hinge connects the guitar body to the guitar neck. The hinge is disposed on one side of the guitar body and guitar neck. A latch plate is secured to the other side of one of the guitar body or guitar neck. A catch member is secured to the other side of the other one of the guitar body or guitar neck. The catch member defines a catch member catch surface. A latch arm is pivotally mounted to the latch plate. A hitch arm is pivotally mounted to the latch arm.

A securement member mounted on the hitch arm, the securement member configured to engage the catch member catch surface. The latch arm, hitch arm and latch plate are configured to vary the distance between the securement member and the catch member catch surface.

The inventive folding guitar comprises a guitar body and a guitar neck which includes a fretboard. A hinge connects the guitar neck to the guitar body. The hinge is configured to enable the guitar neck to pivot relative to the guitar body. A securing means for selectively securing the guitar neck to the guitar body that prevents the guitar neck from pivoting relative to the guitar body. A guitar neck angle adjusting means for adjusting an angle of the guitar neck relative to the guitar body is provided so that a height of a guitar string relative to the fretboard can be adjusted.

The inventive folding guitar has a securing means that includes a distance varying means for varying a distance between the guitar neck and the guitar body.

The securing means comprises a latch plate secured to one of the guitar body and the guitar neck, a catch member secured to the other of the guitar body and guitar neck. The catch member defines a catch member catch surface. A latch arm is pivotally mounted to the latch plate. A hitch arm is pivotally mounted to said latch arm. A securement member is mounted on the hitch arm. The securement member is configured to engage the catch member catch surface, latch arm, hitch arm, and latch plate, which is configured to vary the distance between the securement member and said catch member catch surface.

The inventive folding guitar comprises a guitar body, a guitar neck main portion which includes a fretboard, a guitar neck heel portion, a fixing means for fixing the guitar neck heel portion to the guitar body, a hinge connecting the guitar neck heel portion to the guitar neck main portion. The hinge is configured to enable the guitar neck main portion to pivot relative to guitar body. A securing means is provided for securing the guitar neck main portion to the guitar body to prevent the guitar neck main portion from pivoting relative to the guitar body. A guitar neck angle adjusting means for adjusting an angle of the guitar neck main portion relative to the guitar body so that a height of guitar strings relative to the fretboard can be adjusted.

The fixing means comprises a neck plate having through-holes for receiving and retaining fasteners, the fasteners being configured to engage with and fix the guitar neck heel portion to the guitar body.

The neck plate includes a threaded screw hole, and the guitar neck angle adjusting means comprises a height compensation plate fixed to the guitar body and an adjustment screw. The adjustment screw is screwed into the threaded screw hole and bears against the height compensation plate so that as the adjustment screw is screwed in and backed out of the threaded screw hole the angle of the guitar neck main portion relative to the guitar body is adjusted.

The securing means may comprise, a latch plate secured to one of the guitar body and the guitar neck main portion.

The guitar neck main portion, guitar neck heel portion and guitar body may be comprised of wood and the neck plate is comprised of metal.

The fasteners may be screws.

The securing means includes distance varying means for varying a distance between the guitar neck and the guitar body.

BRIEF DESCRIPTION OF THE DRAWINGS

The operation of the invention will become apparent from the following description taken in conjunction with the drawings, in which:

FIG. 1 is a side view generally illustrating a general implementation of the latch of the present invention;

FIG. 2 is a view similar to FIG. 1, but illustrating hidden portions of parts in phantom lines;

FIG. 3 is an exploded side plan view of the principal components of the inventive latch;

FIG. 4 is a diagrammatic side view of the components of the inventive latch similar to FIG. 2, superimposed over each other in position, but not using any hidden lines;

DETAILED DESCRIPTION OF THE PREFERRED EMBODIMENTS

Figure 5:
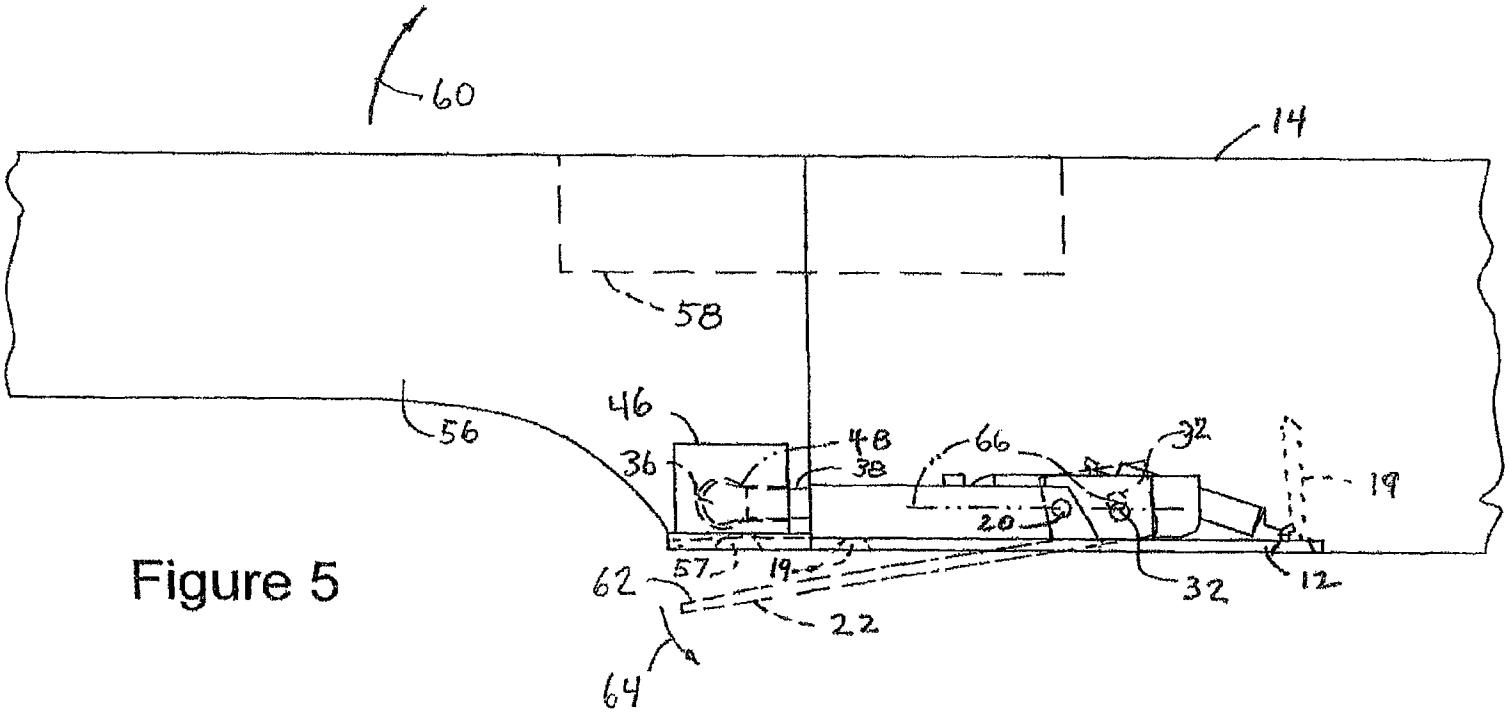
FIG. 5 illustrates operation of the inventive latch.
Figure 6:
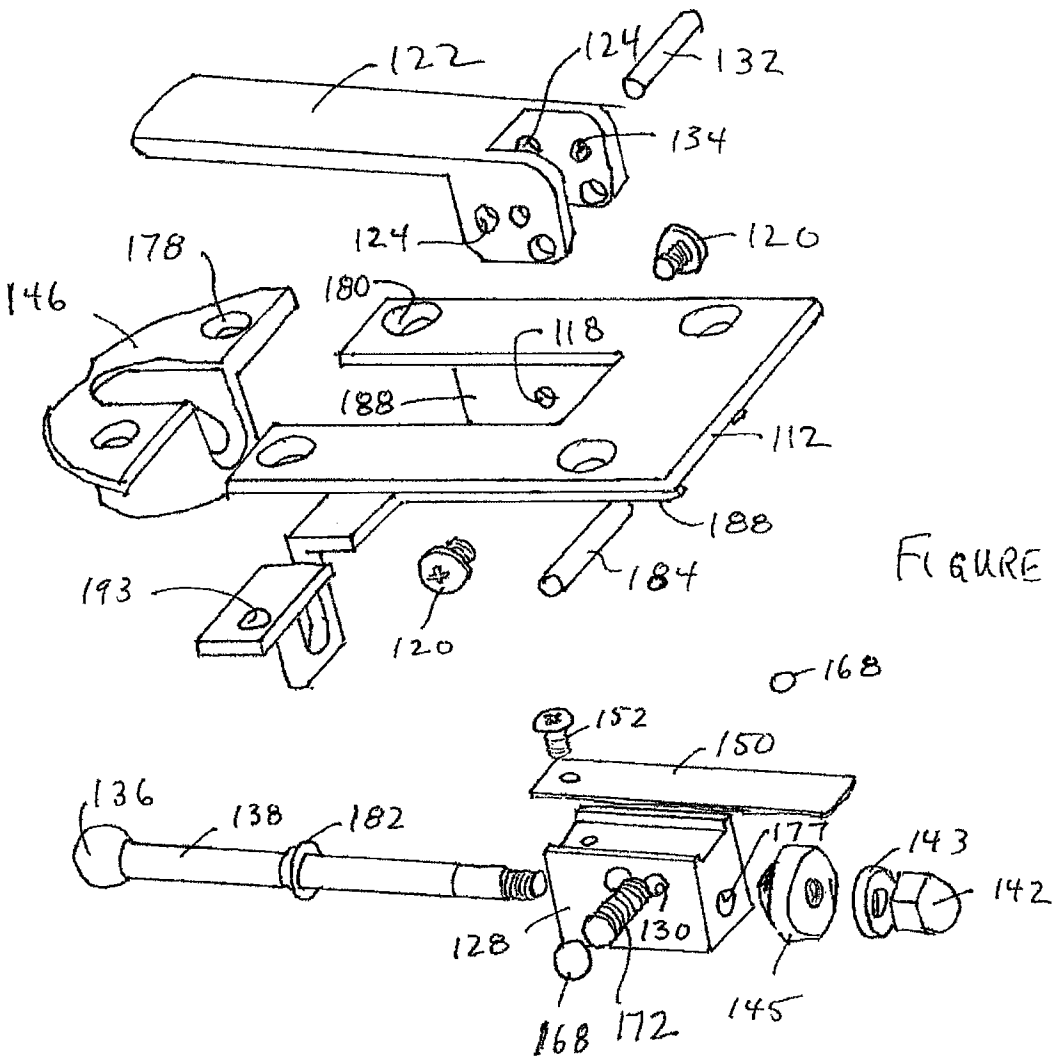
FIG. 6 illustrates another embodiment of the hinge of the present disclosure in exploded perspective.
Figure 7:
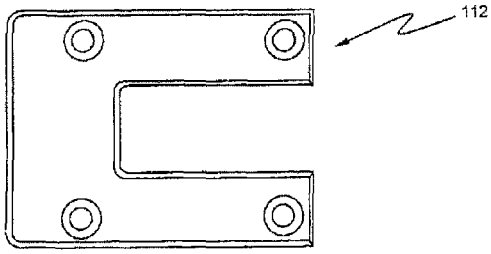
FIG. 7 is a top view of a latch plate of the hinge of FIG. 6.
Figure 10:
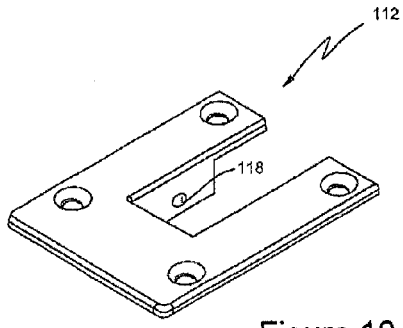
FIG. 10 is a perspective view of the latch plate of FIG. 7.
Figure 8:
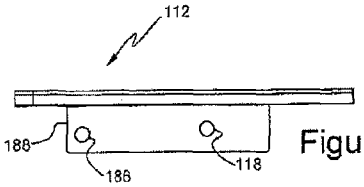
FIG. 8 is a side view of the latch plate of FIG. 7.
Figure 11:
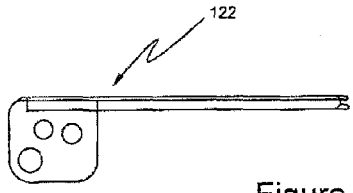
FIG. 11 is a side view of the latch arm of the hinge of FIG. 6.
Figure 9:
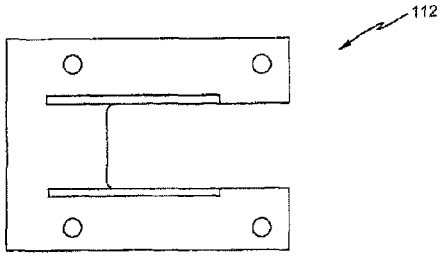
FIG. 9 is a bottom view of the latch plate of FIG. 7.
Figure 12:
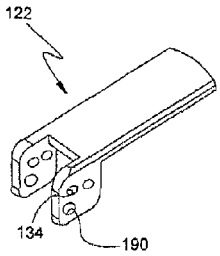
FIG. 12 is a perspective view of the latch arm of the hinge of FIG. 6.
Figure 13:
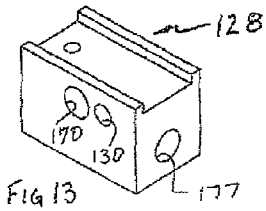
FIG. 13 is a perspective view of the hitch body of the hinge of FIG. 6.
Figure 14:
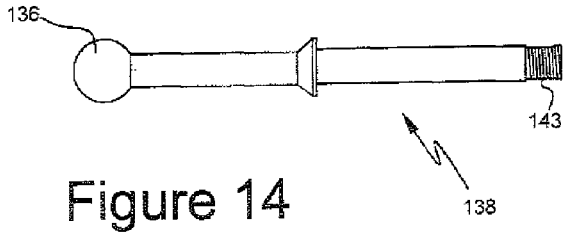
FIG. 14 is a side view of a hitch arm of the hinge of FIG. 6.
Figure 15:
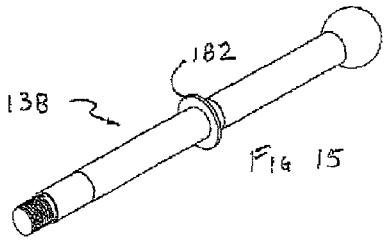
FIG. 15 is a perspective view of a hitch arm of the hinge of FIG. 6.
Figure 16:
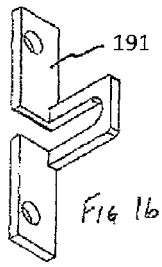
FIG. 16 is a perspective view of the guide of the hinge of FIG. 6.
Figure 17:
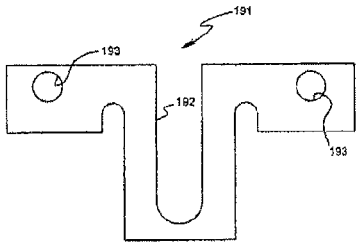
FIG. 17 is a plan view of a guide of the hinge of FIG. 6.
Figure 18:
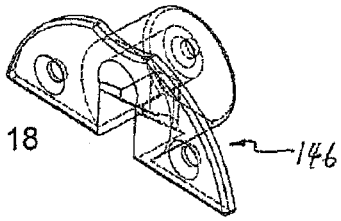
FIG. 18 is a perspective of the heel catch plate of the hinge of FIG. 6.
Figure 19:
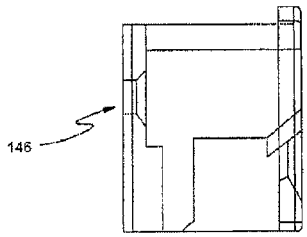
FIG. 19 is a side plan view of the heel catch plate of the hinge of FIG. 6.
Figure 20:
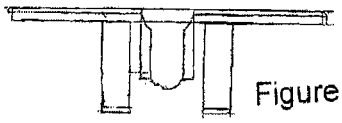
FIG. 20 is a side plan view of the heel catch plate of the hinge of FIG. 6.
Figure 21:
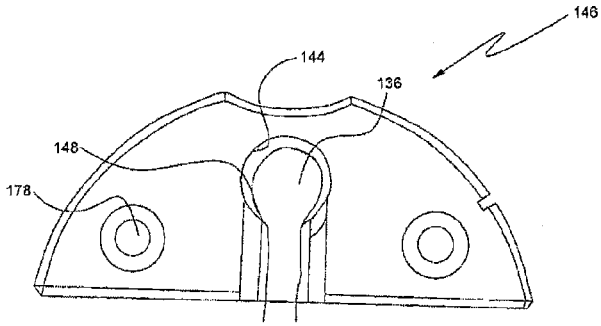
FIG. 21 is a top plan view of the heel catch plate of the hinge of FIG. 6.
Figure 23:
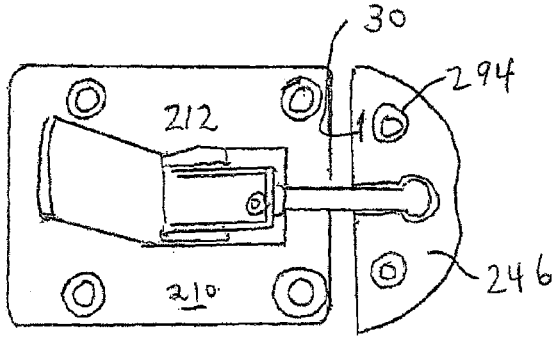
FIG. 23 is a perspective view of the hinge of FIG. 22 with the latch arm in the unlocked position.
Figure 22:
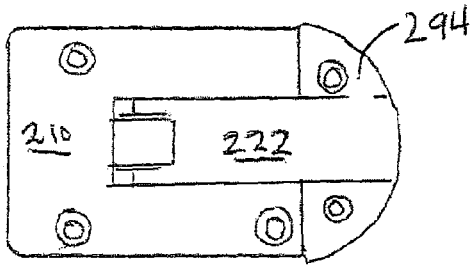
FIG. 22 is a top plan view of a third embodiment of the inventive hinge.
Figure 24:
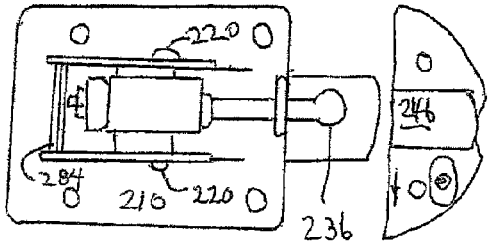
FIG. 24 is a bottom plan view of the hinge of FIG. 22.
Figure 25:
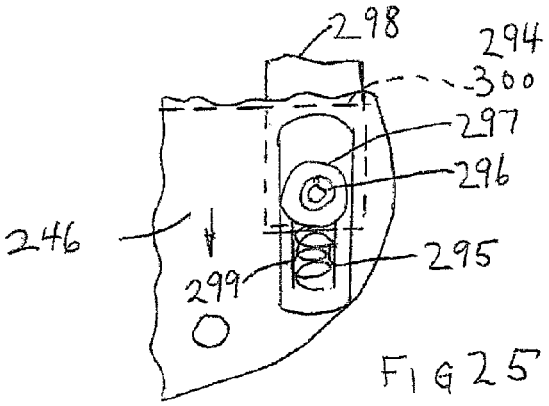
FIG. 25 is a detail of the hinge of FIG. 22.
Figure 26:
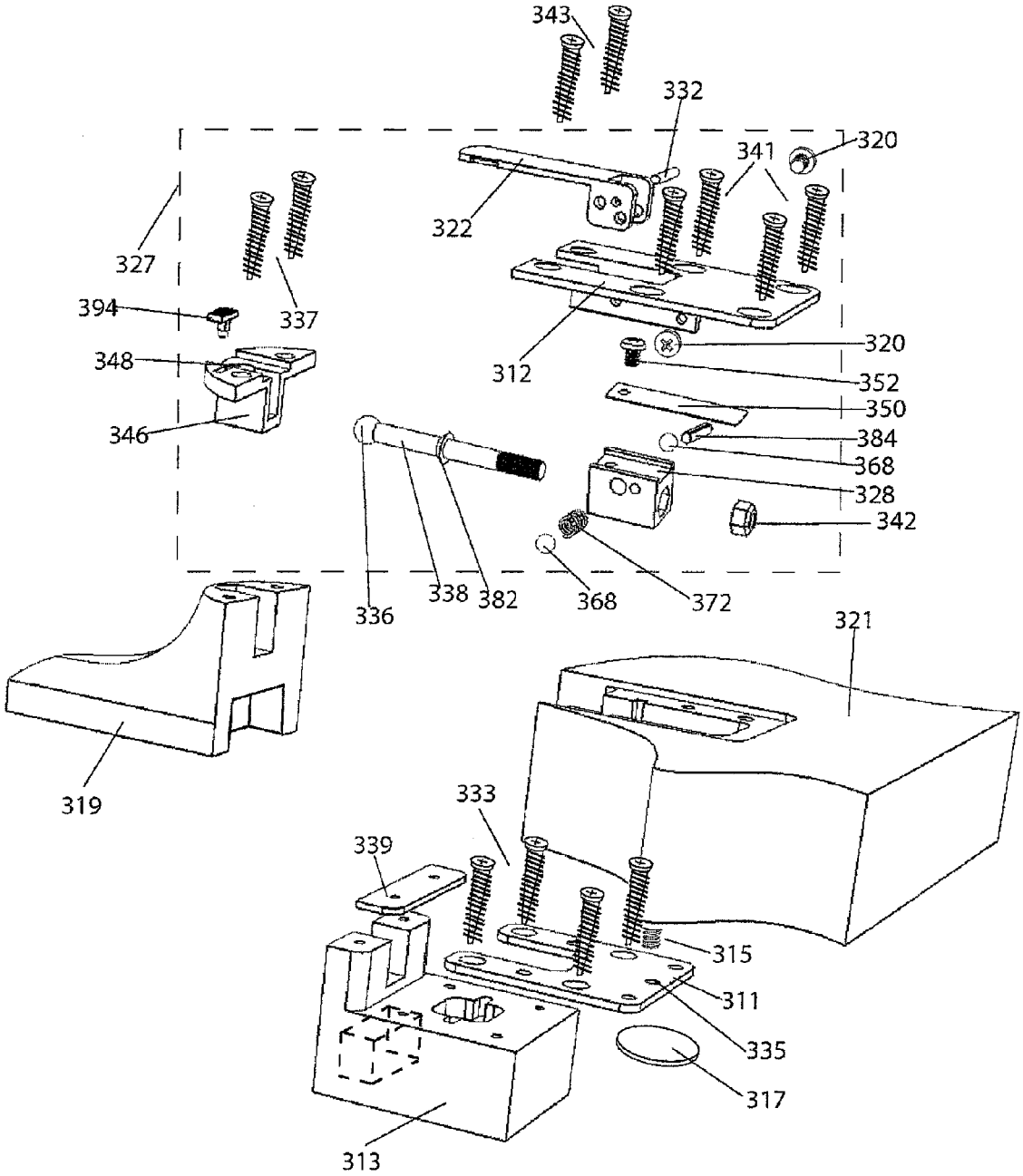
FIG. 26 illustrates another embodiment of the hinge of the present disclosure in exploded perspective.
Figure 27:
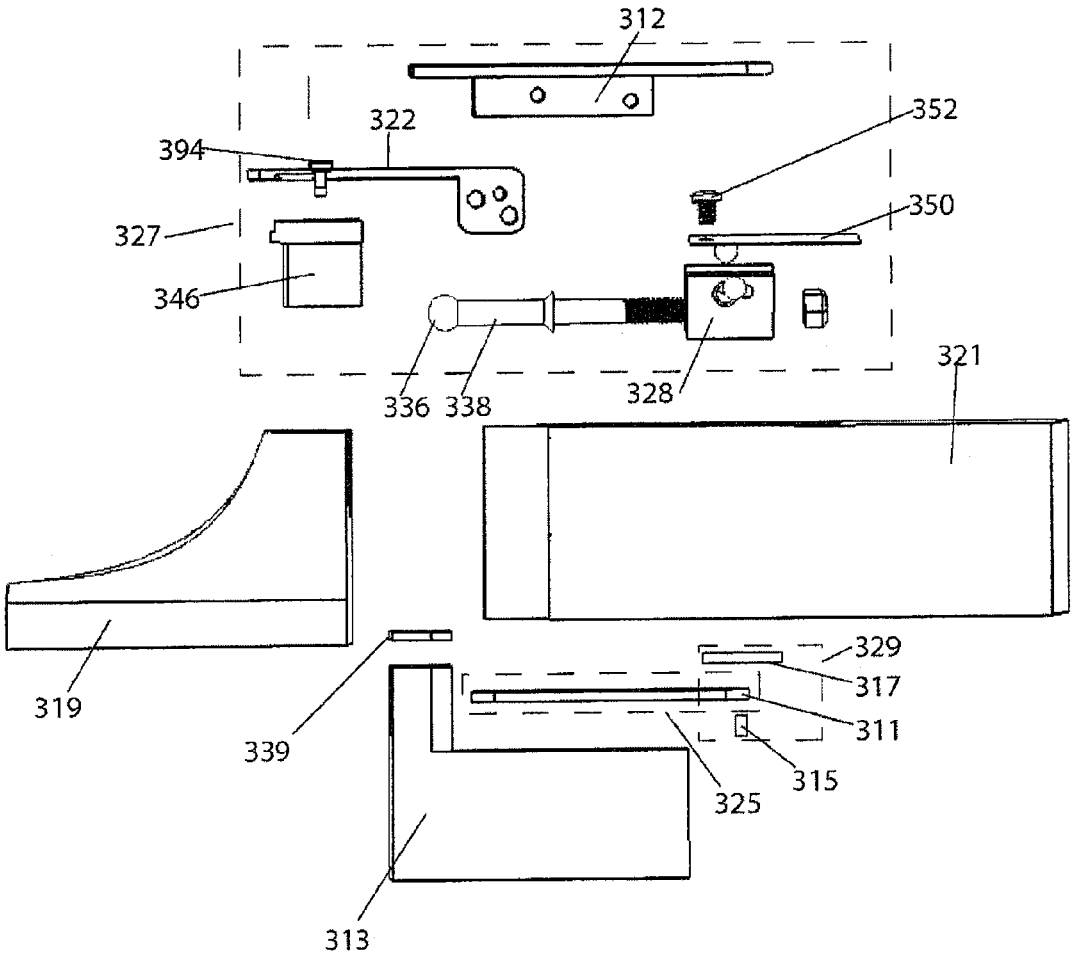
FIG. 27 is an exploded side plan view of the principal components of the inventive latch of the hinge of FIG. 26.
Figure 28:
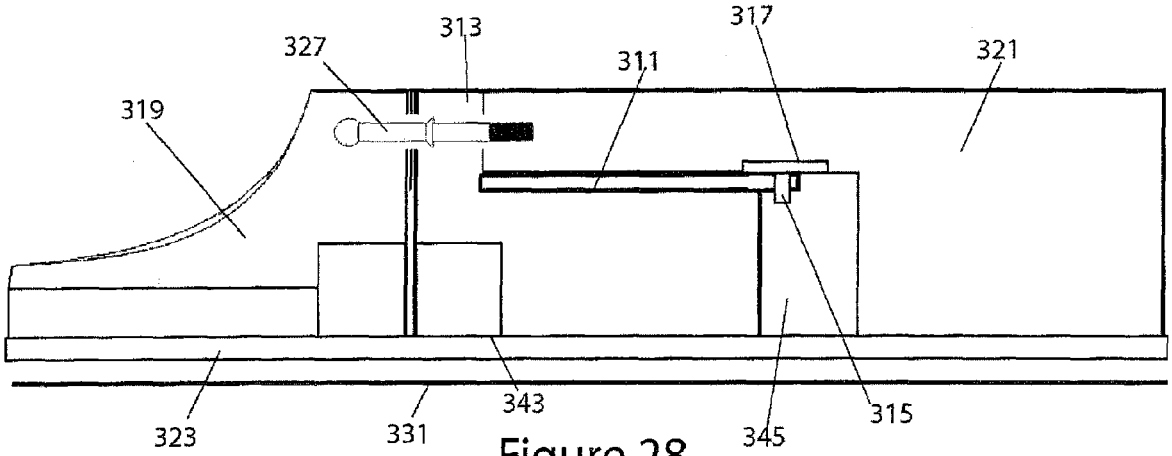
FIG. 28 is a diagrammatic side view of the components of the inventive latch similar to FIG. 26, superimposed over each other in position, but not using any hidden lines.
Figure 29:
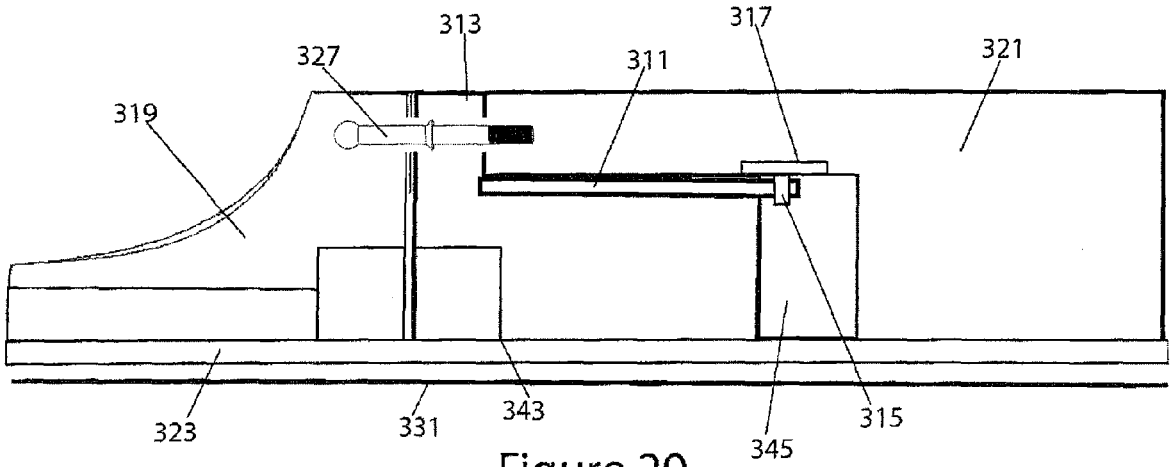
FIG. 29 is a diagrammatic side view of the components of the inventive latch similar to FIG. 26, superimposed over each other in position, but not using any hidden lines.

Referring to FIGS. 1-5, and in particular initially to FIG. 1, a latch 10, constructed in accordance with the present invention is illustrated. Latch 10 comprises a guitar body base plate 12 which is secured to the body 14 of a guitar (FIG. 5) by screws 19, which are secured in holes in guitar body 14. Base plate 12 includes integral upstanding walls 16. Walls 16 include holes 18 which support short pivot pins or screws 20. Screws 20 screw into the threaded holes 18, and fit into holes 24. Latch arm 22 rotates on the end of screws 20. Thus, latch arm 22 (which includes holes 24 which receive screws 20) is rotatably mounted on pivot pin 20.

A hitch arm 26 comprises a base 28 which defines a hole 30. A pin 32 is mounted in hole 30 in hitch arm 26 and hole 34*s* in latch arm 22. This allows for rotational movement between hitch arm 26 and latch arm 22.

The distance by which the ball 36 is positioned with respect to the end of base 28 is adjusted by screw arm 38, by rotation of screw arm 38 which is screwed into a tapped hole 40 in base or hitch body 28. The rotary position of screw arm 38 may be locked by rotation of nut 42. Nut 42 rotates on threads 43. It is noted that threads 43 also mate with tapped hole 40.

Ball 36 engages a socket 44 in heel catch plate 46 at an arc shaped engagement surface 48. The structure of the hinge is completed by a spring 50 which is mounted in tension between a hook 52 on hitch arm 26, and a hook 54 on guitar body base plate 12.

The operation of the inventive latch may be understood from FIG. 5. In the locking position, latch 10 takes the position illustrated in the solid lines, with heel catch plate 46 mounted in folding guitar neck 56 by screws 57. If it is desired to put the guitar in the travel position, it is folded about hinge 58 in the direction of arrow 60. In order to do this, it is necessary to release latch 10. This is done by pulling latch arm 22 to the position illustrated in phantom lines in FIG. 5. This is facilitated by tapered surface 62 which allows the user to insert a fingernail to pull latch arm 22 out in the direction of arrow 64. This also allows ball 36 to be moved in the direction of arrow 64 and exit heel catch plate 46.

The operation of latch 10 is much like a Visegrips® brand locking pliers. More particularly, in the position illustrated in broken lines in FIG. 5, pin 32 is relatively far from arc-shaped engagement surface 48. When the center of pin 32 passes over the center line 66 of screw 20, pin 32 is closer to engagement surface 48. It is then so close to engagement surface 48 that significant pressure is exerted between ball 36 and engagement surface 48. As pin 32 continues to the position shown in solid lines in FIG. 5, this pressure is somewhat reduced as the distance between pin 32 becomes somewhat larger again. Thus, the latch securely joins neck 56 to body 14, and is held in that position because the tension acting on screw arm 38 tends to pull neck 56 toward body 14.

Referring now to FIGS. 6-21, another embodiment of the hinge is illustrated. This embodiment operates much the same way as the embodiment of FIGS. 1-5, and analogous or corresponding parts are labeled with numbers 100 higher than the numbers of the corresponding or analogous parts in the embodiment of FIGS. 1-5.

More particularly, latch 110 comprises a latch arm 122 mounted for rotation on screws 120 which pass through tapped holes 118 in latch plate 112. The ends of screws 120 extend into holes 124 in latch arm 122 to support latch arm 122 for rotation with respect to latch plate 112.

Pin 132 is jam fitted into hole 130. The ends of pin 132 extend into and are loosely fitted to holes 134 in latch arm 122. A pair of balls 168 are received within hole 170 at opposite ends of hole 170. A coil spring 172 is held in compression between balls 168. In the position where latch arm 122 is parallel to latch plate 112 and flush with latch plate 112, balls 168 are driven toward holes 124, thus positively locking latch arm 122 in place.

A leaf spring 150 is secured to hitch body 128 by a bolt 152, which screws into hole 174 in hitch body 128. When latch arm 122 is pulled from the guitar neck to allow the guitar neck to be folded, leaf spring 150 urges ball 136 away from latch arm 122, facilitating the folding of the guitar neck.

Hitch arm 138 passes through hole 177 in hitch body 128. Rubber washer 145, washer 143 and locking nut 142 are mounted on the end 176 of hitch arm 138. When latch arm 122 is flush with latch plate 112, latch arm 122 pulls the end 176 of hitch arm 138 together with rubber washer 145, washer 143 and locking nut 142 toward heel catch plate 146. Rubber washer 144 acts like a spring to apply a locking force. This results in an exertion of force without applying that force to the wood surrounding the screws which are used to secure the latch to the guitar body and neck. More particularly, screws, not illustrated, pass through holes 178 in heel catch plate 146, and holes 180 in latch plate 112.

Excess movement of hitch arm 138 is limited by skirt 182. The movement of hitch arm 138 is limited by locking cap nut 142, which when the latch is opened, is caused to bear against spring pin 184, which is mounted in holes 186 in perpendicular extensions 188 of latch plate 112.

When latch arm 122 is fully extended, holes 190 are in engagement with balls 168.

A guide 191 includes a guide surface 192 which guides the exit of hitch arm 138 from heel catch plate 146 during folding of the guitar neck. Holes 193 receive the same screws as holes 180 illustrated in FIG. 6. If desired, guide 191 and heel catch plate 146 may be cast as a single part.

Yet another embodiment of the invention is illustrated in FIGS. 22 through 25. In this embodiment, corresponding and analogous parts have been given numbers 100 higher than corresponding and analogous parts of the embodiment of FIG. 6-21.

Latch 210 comprises a latch arm 222 mounted in a latch plate 212. A ball 236 mounts in a heel catch plate 246. A sliding latch lock 294 is mounted in a slot 295, within which it slides. In the position illustrated in FIG. 22, latch lock 294 overlies latch arm 222, thus positively retaining latch arm 222 in the locked position. Rivet 296 is secured to lock 294 and maintained in slot 295 by a washer 297. This allows the end 298 of lock 294 to be driven against the force of spring 299 in the direction of arrow 301 over the edge 300 of heel catch plate 246. This allows latch arm 222 to be rotated into the unlocked position analogous to the position illustrated in broken lines in FIG. 5, thus allowing the guitar neck to be folded over the body.

An alternative embodiment is illustrated in FIGS. 26-29. In this alternative embodiment, parts for performing similar, identical, or analgous functions are number 300 higher than the corresponding parts of FIGS. 1-5, 200 higher than the corresponding parts of FIGS. 6-21 and 100 higher than the corresponding parts of FIGS. 22-25.

The embodiment shown in FIGS. 26-29, is similar to the previous embodiment, except that a metal plate referred to herein as a neck plate 311 is fitted and secured to the guitar neck heel portion 313. The neck plate 311 is provided with a tapped hole which receives an adjusting bolt 315 which passes through the neck plate 311 and bears against a screw disk 317, thus rotating the guitar neck heel portion 313 about its opposite side (the side that is adjacent the guitar neck main portion 319). Because the opposite side of the guitar neck heel portion 313 is secured to the guitar neck main portion 319 (in the manner described in conjunction with the prior embodiment), this results in adjusting the angle between the guitar neck and the body of the guitar, accommodating normal manufacturing tolerances in the comparatively complex inventive hinged guitar, and insuring a properly aligned manufactured product.

More particularly, as shown in FIGS. 1-4, in accordance with the present invention, a folding guitar is provided that includes guitar body 321, a guitar neck main portion 319 having a fretboard 323, and a guitar heel portion 313. Fixing means 325 are provided for fixing the guitar neck heel portion 313 to the guitar body 321. A hinge is provided connecting the guitar neck heel portion 313 to the guitar neck main portion 319. The hinge is disposed on one side of the assembled guitar neck main portion 319, guitar neck heel portion 313 and guitar body 321. The hinge is configured to enable the guitar neck main portion 319 to pivot and fold relative to guitar body 321 so that the guitar can be made more compact.

Securing means 327 is assembled in the manner described in FIG. 1-25 and is provided for securing the guitar neck main portion 319 to the guitar body 321 so that when the guitar neck main portion 319 is in the open position suitable for playing guitar, the guitar neck main portion 319 is secure and prevented from pivoting relative to the guitar neck heel portion 313.

Guitar neck angle adjusting means 329 is provided for adjusting an angle of the guitar neck main portion 319 relative to the guitar neck heel portion 313 so that the height of guitar strings 331 relative to fretboard 323 can be adjusted. The guitar neck angle adjusting means 329 allows for fine adjustment of the height of the guitar strings 331 relative to the fretboard 323.

The fixing means 325 may comprise a neck plate 311 having through-holes for receiving and retaining fasteners, the fasteners being configured to engage with and fix the guitar neck heel portion 313 to the guitar body 321. The guitar neck main portion 319, guitar neck heel portion 313 and guitar body 321 may be comprised of wood and the neck plate 311 comprised of metal, so that the neck plate 311 provides a strong and durable structure for fixing the guitar neck portion to the guitar body 321. The fasteners may be wood screws 333 having screw heads that are larger than the through-holes so that the wood screws 333 securely clamp the neck plate 311 to the guitar neck heel portion 313.

The neck plate 311 may include a threaded screw hole 335. The guitar neck angle adjusting means 329 the comprising a screw disk 317 fixed to the guitar body 321 and the adjusting bolt 315 screwed into the threaded screw hole 335 and bearing against the screw disk 317. As the adjusting bolt 315 is screwed into and backed out of the threaded screw hole 335, the angle of the guitar neck main portion 319 relative to the guitar body 321 is adjusted.

The securing means 327 may include (a) a latch plate 312 secured to the guitar body 321, (b) a catch member 346 secured to the guitar neck main portion 319, said catch member 346 defining a catch member catch surface 348, (c) a latch arm 322 pivotally mounted to said latch plate 312, (d) a hitch body 328 pivotally mounted to said latch arm 322, and (e) a ball 336 of a securement member (screw arm 338) mounted on said hitch body 328, said ball 336 of the securement member configured to engage said catch member catch surface 348, said latch arm 322, hitch body 328 and latch plate 312 being configured to vary the distance between said ball 336 of the securement member and said catch member catch surface 348.

The height of the guitar strings 331 relative to the fretboard 323 is critical. In accordance with the present invention, the neck angle can be adjusted to compensate for manufacturing tolerances so that the gap between the strings 331 and the fretboard 323 can be finely adjusted. By the construction defined by the present invention, a folding guitar is provided that can effectively be assembled using mass production techniques, such that each mass produced guitar can be individually fine tuned so that the action of the guitar, as determined by the height of the strings 331 relative to the guitar neck fretboard 323, is adjustable.

In preparation for the assembly of the inventive folding guitar, neck heel index pins are inserted in the guitar neck heel portion 313 and fixed in place using glue. Neck heel index tubes are then inserted into the guitar neck heel portion 313. The catch member 348 is fixed to the guitar neck heel portion 313 using catch member screws 337. A hinge index pin is inserted into one half of the hinge body and left sticking out about 3 mm. The hinge index pin is fixed to the hinge using glue applied from the back side of the hinge. Pilot holes are pre-drilled into the guitar neck main portion 319 and guitar neck heel portion 313. The hinge is set without a hinge index pin into a neck space 345 in the guitar main portion 319 and fixed in place with a hinge wood screw. The adjusting bolt 315 is threaded into the neck plate 311. The neck plate 311 is attached to the guitar neck heel portion 313 using neck plate wood screws 333. The screw disk 317 is glued into the neck pocket of the guitar body 321.

To assemble the inventive folding guitar, with the front side of the guitar body 321 facing up, the guitar neck heel portion 313 is inserted into the neck pocket of the guitar body 321. The guitar body 321 is turned over and the latch plate 312 is put in place. Four latch plate screws 337 are inserted into corresponding through-holes on the latch plate 312 and threaded to corresponding threaded holes in the neck plate 311, and left not tightened. A height compensation plate 339 is pushed underneath the end of the latch plate 312 and above the screw arm 338 and guitar neck heel portion 313.

Square nuts are placed into the cutouts of the hinge pocket 345 and latch plate screws 343 inserted through corresponding through-holes in the latch plate 312 and the height compensation plate 339 and threaded into the square nuts without tightening.

The guitar neck main portion 319 is joined to the guitar neck heel portion 313 and the hinge is fixed to the guitar neck main portion 319 with a hinge wood screw.

The guitar neck main portion 319 is unfolded, and the ball of the ball 336 of the securement member is pushed into the catch member 348 by pushing down on the latch. The length of the screw arm 338 can be adjusted. If the length is too long and the guitar neck main portion 319 and guitar neck heel portion 313 are not brought together tight enough, the length of the screw arm 338 can be adjusted by turning it clockwise. If the screw arm 33 is too short and the ball does not slip smoothly into the catch member 348, it can be lengthened by turning it counter-clockwise.

The neck angle is checked and is accessed through and adjusted by rotating bolt 315*m* which bears against the screw disk 317 and sets the angle of the guitar neck main portion 319 relative to the guitar body 321.

Once the fine adjustment of the neck angle has been made, the latch plate screws 341 are tightened in crosswise fashion (e.g. bottom-left, top-right, bottom-right, top-left). This tightening process is repeated using low force until the latch plate screws have even tightness.

The neck angle is checked again and if it needs to be re-adjusted, the rear latch plate screws 339 are loosened, and the forward latch plate screws are loosened slightly. Then the adjusting bolt is adjusted again, and then the latch plate screws 339 retightened. Finally, latch plate screws 343 are tightened to complete the assembly process.

While illustrative embodiments of the invention have been described, it is noted that various modifications will be apparent to those of ordinary skill in the art in view of the above description and drawings. Such modifications are within the scope of the invention which is limited and defined only by the following claims.

While illustrative embodiments of the invention have been described, it is noted that various modifications will be apparent to those of ordinary skill in the art in view of the above description and drawings. Such modifications are within the scope of the invention which is limited and defined only by the following claims.

What is claimed:

1. A folding guitar, comprising:

(a) a guitar body;

(b) a guitar neck having a fretboard;

(c) a hinge connecting said guitar neck to said guitar body, the hinge being configured to enable the guitar neck to pivot relative to the guitar body;

(d) securing means for selectively securing the guitar neck to the guitar body to prevent the guitar neck from pivoting relative to the guitar body; and (e) guitar neck angle adjusting means for adjusting an angle of the guitar neck relative to the guitar body so that a height of guitar strings relative to the fretboard can be adjusted.

2. A folding guitar according to claim 1, wherein the securing means includes distance varying means for varying a distance between the guitar neck and the guitar body.

3. A folding guitar, comprising:

(a) a guitar body;

(b) a guitar neck main portion having a fretboard;

(c) a guitar neck heel portion;

(d) fixing means for fixing the guitar neck heel portion to the guitar body;

(e) a hinge connecting said guitar neck heel portion to said guitar neck main portion, the hinge being configured to enable the guitar neck main portion to pivot relative to guitar body;

(f) securing means for securing the guitar neck main portion to the guitar body to prevent the guitar neck main portion from pivoting relative to the guitar body; and (g) guitar neck angle adjusting means for adjusting an angle of the guitar neck main portion relative to the guitar body so that a height of guitar strings relative to the fretboard can be adjusted.

4. A folding guitar, comprising:

(a) a guitar body;

(b) a guitar neck main portion having a fretboard;

(c) a guitar neck heel portion;

(d) fixing means for fixing the guitar neck heel portion to the guitar body, wherein the fixing means comprises a neck plate having through-holes for receiving and retaining fasteners, the fasteners being configured to engage with and fix the guitar neck heel portion to the guitar body;

(e) a hinge connecting said guitar neck heel portion to said guitar neck main portion, the hinge being configured to enable the guitar neck main portion to pivot relative to guitar body;

(f) securing means for securing the guitar neck main portion to the guitar body to prevent the guitar neck main portion from pivoting relative to the guitar body; and (g) guitar neck angle adjusting means for adjusting an angle of the guitar neck main portion relative to the guitar body so that a height of guitar strings relative to the fretboard can be adjusted.

5. A folding guitar according to claim 4, wherein the neck plate includes a threaded screw hole, and the guitar neck angle adjusting means comprises a height compensations plate fixed to the guitar body and an adjustment screw, the adjustment screw being screwed into the threaded screw hole and bearing against the height compensation plate so that as adjustment screw is screwed in and backed out of the threaded screw hole the angle of the guitar neck main portion relative to the guitar body is adjusted.

6. A folding guitar according to claim 3, wherein the securing means comprises:

(a) a latch plate secured to one of the guitar body and the guitar neck main portion;

(b) a catch member secured to the other of the guitar body and guitar neck main portion, said catch member defining a catch member catch surface;

(c) a latch arm pivotally mounted to said latch plate;

(d) a hitch arm pivotally mounted to said latch arm; and (e) a securement member mounted on said hitch arm, said securement member configured to engage said catch member catch surface, said latch arm, hitch arm and latch plate being configured to vary the distance between said securement member and said catch member catch surface.

7. A folding guitar according to claim 3, wherein the guitar neck main portion, guitar neck heel portion and guitar body are comprised of wood and the neck plate is comprised of metal.

8. A folding guitar according to claim 3, wherein the fasteners are screws.

9. A folding guitar according to claim 3, wherein the securing means includes distance varying means for varying a distance between the guitar neck and the guitar body.

10. A folding guitar, comprising:

(a) a guitar body;

(b) a guitar neck having a fretboard;

(c) a hinge connecting said guitar neck to said guitar body, the hinge being configured to enable the guitar neck to pivot relative to the guitar body;

(d) securing means for selectively securing the guitar neck to the guitar body to prevent the guitar neck from pivoting relative to the guitar body, wherein said securing means includes distance varying means for varying a distance between the guitar neck and the guitar body and said securing means comprises:

(i) a latch plate secured to one of the guitar body and the guitar neck;

(ii) a catch member secured to the other of the guitar body and guitar neck, said catch member defining a catch member catch surface;

(iii) a latch arm pivotally mounted to said latch plate;

(iv) a hitch arm pivotally mounted to said latch arm; and (v) a securement member mounted on said hitch arm, said securement member configured to engage said catch member catch surface, said latch arm, hitch arm, and latch plate being configured to vary the distance between said securement member and said catch member catch surface; and (e) guitar neck angle adjusting means for adjusting an angle of the guitar neck relative to the guitar body so that a height of guitar strings relative to the fretboard can be adjusted.

* * * * *